US005397024A

United States Patent [19]

Wu et al.

[11] Patent Number: 5,397,024

[45] Date of Patent: Mar. 14, 1995

[54] STRUCTURE OF CONTAINER

[76] Inventors: Ching-Lieh Wu, No. 2, Alley 11, Ta Ming Lane, Sec. 1, Chung Hsin Rd., Ta Li Hsiang; Jui-Te Wang, No. 23-45, Lane 940, Chung Cheng Rd., Wu Fong Hsiang, both of, Taichung Hsien, Taiwan, Prov. of China

[21] Appl. No.: 227,322

[22] Filed: Apr. 14, 1994

[51] Int. Cl.[6] ..... B65D 51/16

[52] U.S. Cl. ..... 220/231; 220/356; 220/361; 220/366; 215/309; 215/315; 251/322; 251/323

[58] Field of Search ..... 220/231, 352, 356, 357, 220/360, 361, 366, 367, 373; 215/307, 309, 311, 315; 251/322, 323

[56] References Cited

U.S. PATENT DOCUMENTS 1,159,687 11/1915 Kraft ..... 220/231 X
3,133,664 5/1964 Koch ..... 220/231
4,646,933 3/1987 Jurczenia et al. ..... 220/366
5,065,889 11/1991 Conti ..... 220/366

*Primary Examiner*—Allan N. Shoap
*Assistant Examiner*—Nova Stucker
*Attorney, Agent, or Firm*—Vandell Legal Group

[57] ABSTRACT

A container includes a top-open container body having a tapered top-flange around the top opening thereof, and a top cover having a tapered bottom flange fitted around the top flange of the container body, wherein the top cover has a stepped air hole and a push-button plug assembly mounted within the stepped air hole and pressed to control the passage; the top cover has a recessed retaining portion moved to engage with a raised retaining portion on the container body for letting air pass through air guide grooves on the top cover and container body into the inside space of the container body.

3 Claims, 4 Drawing Sheets

STRUCTURE OF CONTAINER

BACKGROUND AND SUMMARY OF THE INVENTION

The present invention relates to containers, and more particularly relates to a sealing arrangement for sealing a plastic container against moisture.

A regular plastic container is generally comprised of a container body having a top flange around the top opening thereof, and a top cover having a bottom flange around the periphery. The top flange of the container body is plugged into (or threaded into) the bottom flange of the top cover. When fastened, moist air can still pass through the gap between the top flange of the container body and the bottom flange of the top cover and enter the inside space of the container body to moisten the materials received inside the container.

The present invention has been accomplished to provide a plastic container which eliminates the aforesaid problem. This object is achieved by providing an air passage on the top cover and an air passage between the top cover and the container body and respectively controlled to change the air pressure between the inside and the outside so that the connection between the top cover and the container body is air tightly sealed, and moisture is prohibited from entering the container.

DETAILED DESCRIPTION OF THE PREFERRED EMBODIMENT

Figure 1:
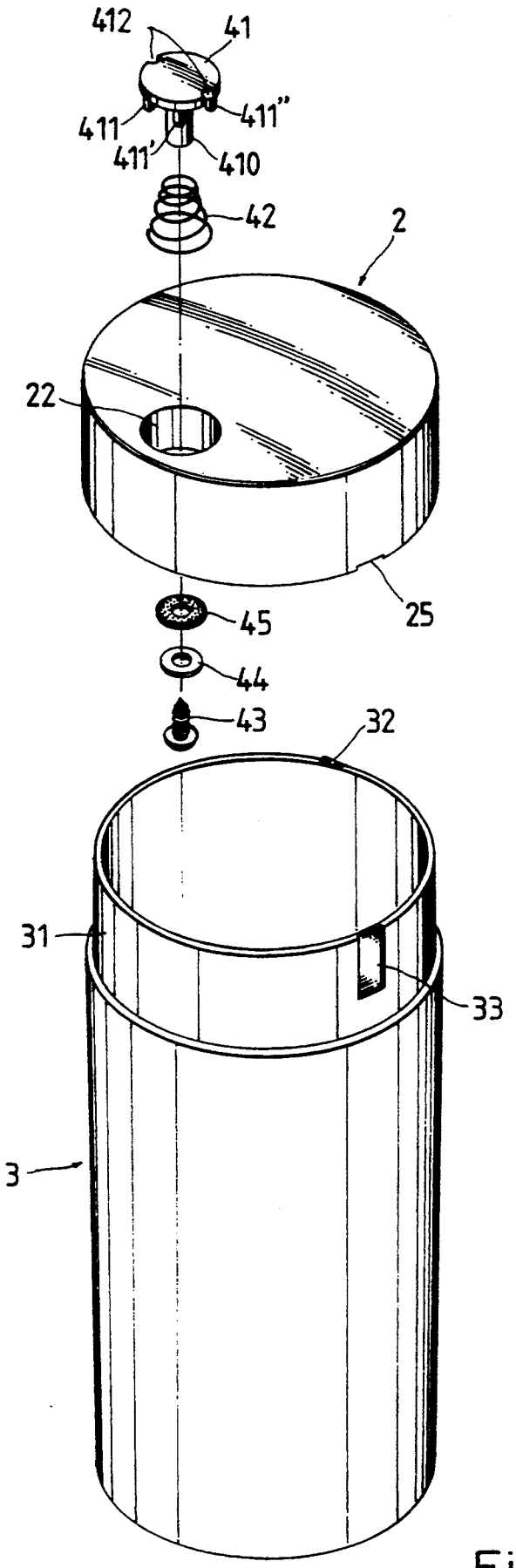
FIG. 1 is an exploded view of a container according to the present invention.
Figure 2:
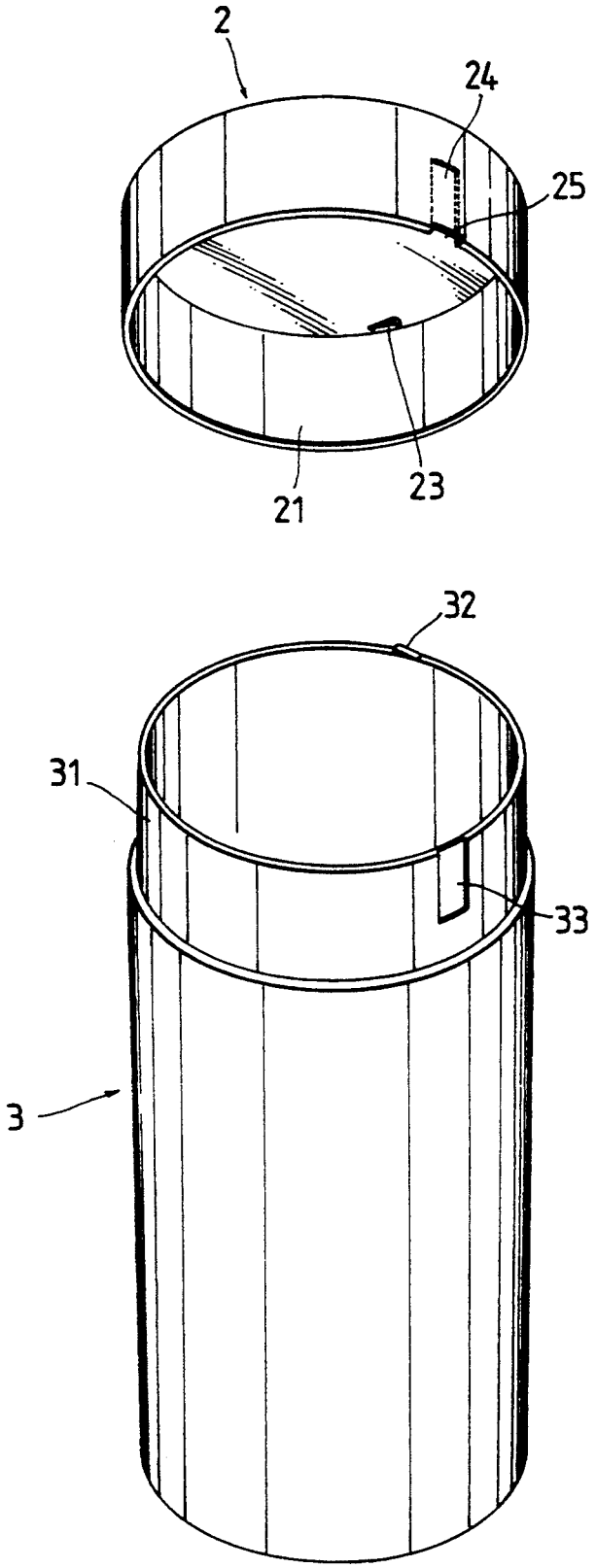
FIG. 2 is an elevational view of the container body and top cover of the container shown in FIG. 1.
Figure 3:
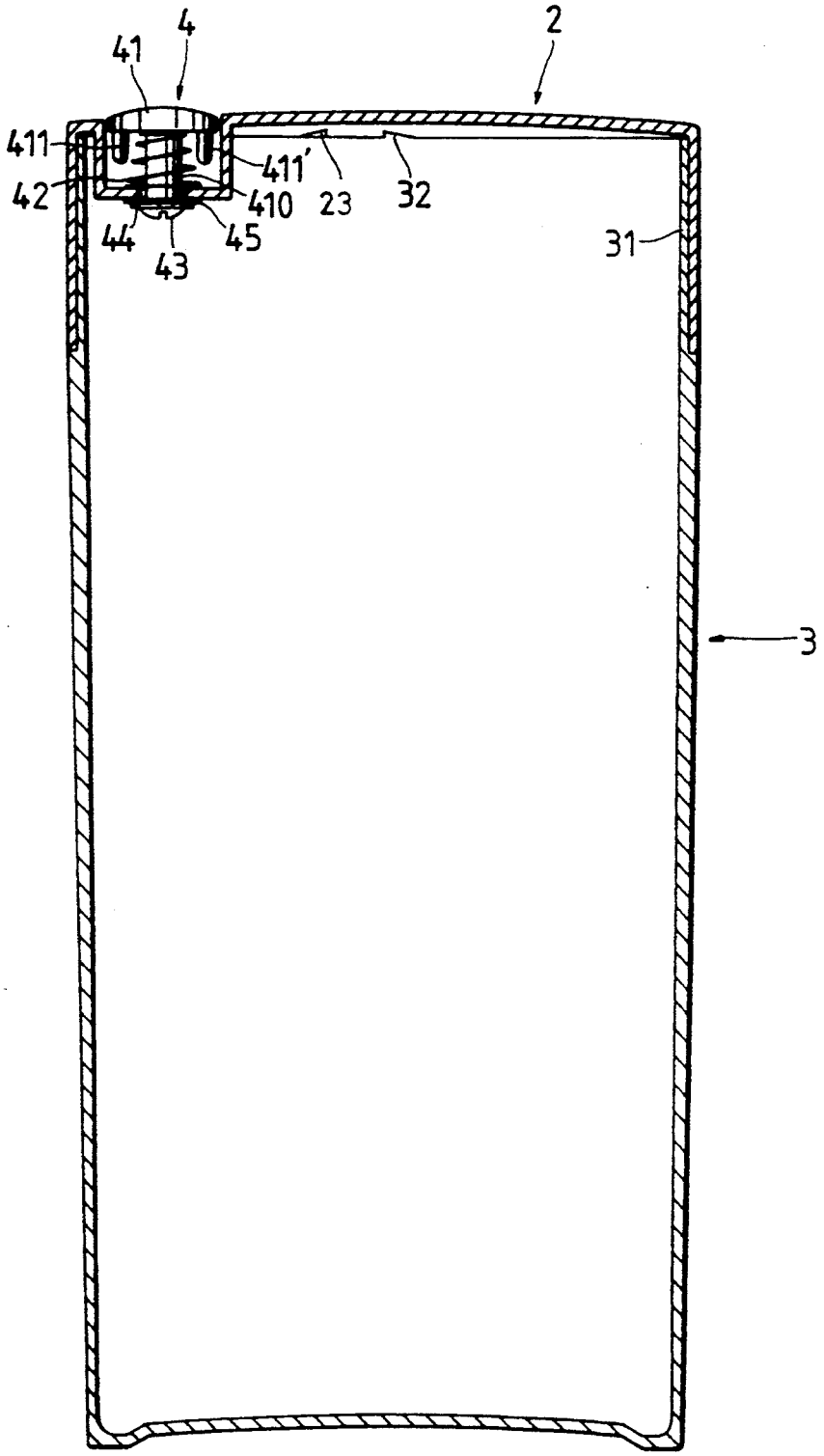
FIG. 3 is a longitudinal view in section of the container shown in FIG. 1, showing the air hole on the top cover thereof sealed.
Figure 4:
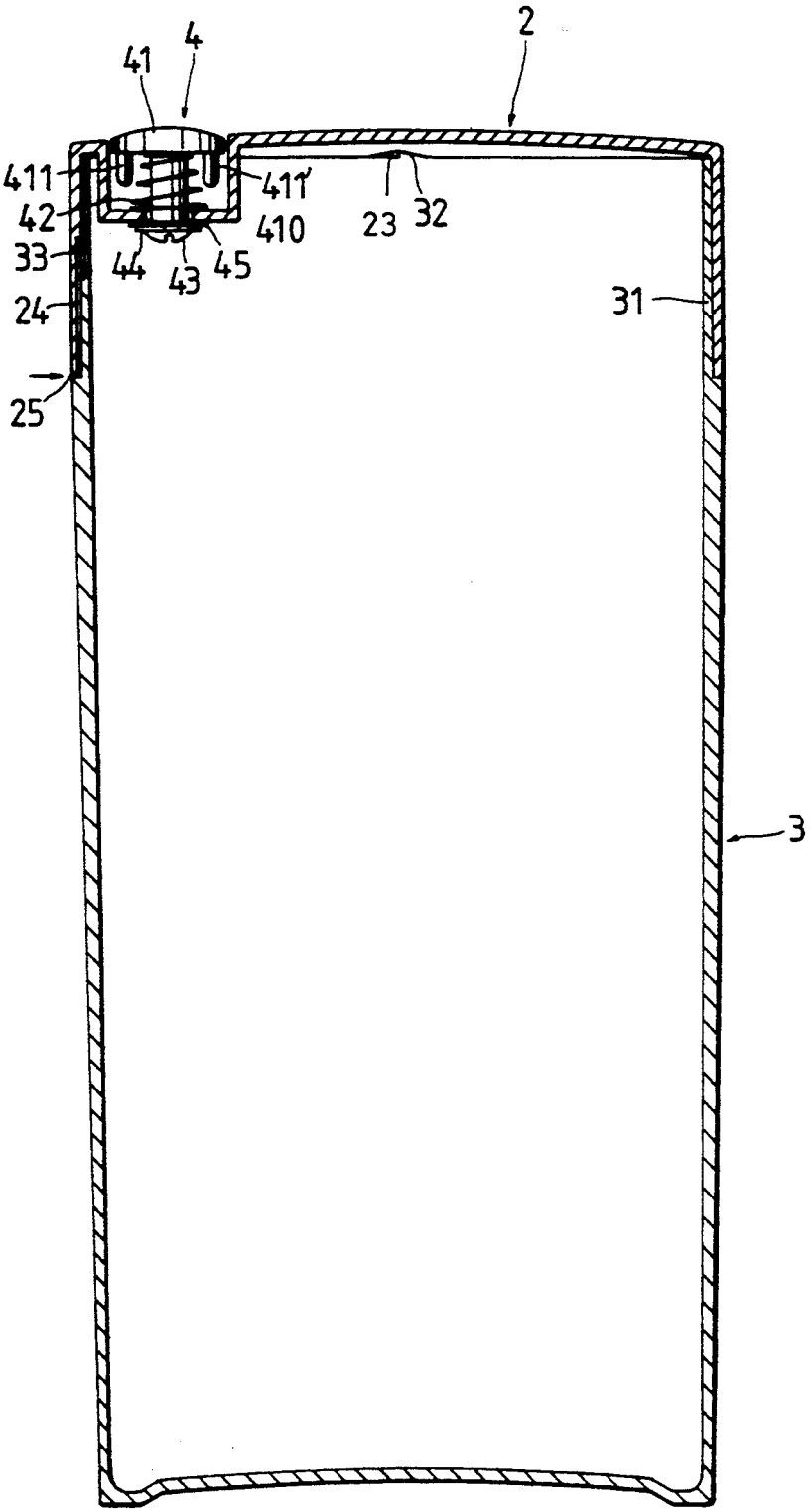
FIG. 4 is similar to FIG. 3 but showing the air guide grooves thereof aligned, permitting outside air to enter the container body.

Referring to FIGS. 1 through 4, a plastic container in accordance with the present invention is generally comprised of a top cover 2, a top-open container body 3, and a push-button plug assembly 4.

The top cover 2 comprises a bottom flange 21 perpendicularly downwardly extended from the border thereof and made gradually bigger toward the bottom, a stepped air hole 22 at the top, which receives the valve assembly 4, a recessed retaining portion 23 on the inside, an air guide groove 24 on the bottom flange 21 on the inside, and a notch 25 on the bottom flange 21 at the bottom of the longitudinal groove 24.

The top-open container body 3 comprises a top flange 31 disposed around the top opening thereof and made gradually smaller toward the top and fitted into the space defined within the bottom flange 21 of the top cover 2, a raised retaining portion 32 on the top flange 31 at the top and moved to engage the recessed retaining portion 23 on the top cover 2, and an air guide groove 33 on the top flange 31 on the outside corresponding to the air guide groove 24 on the top cover 2. When the top cover 2 is covered on the container body 3 and the recessed retaining portion 23 is engaged with the raised retaining portion 32, the air guide grooves 24; 33 are aligned, and outside air is allowed to enter from the notch 25 through the air guide grooves 24; 33 into the container body 3. If the recessed retaining portion 23 is disconnected from the raised retaining portion 32 when the top cover 2 is covered on the container body 3, the air guide grooves 24; 33 are not aligned, and notch 25 therefore outside air is prohibited from entering the container body 3 through the air guide groove 33.

The push-button plug assembly 4 comprises a headed plug rod 41 having two opposite notches 412 and a plurality of downward projecting strips 411; 411'; 411" on the head thereof and an elongated plug rod body 410 inserted through the stepped air hole 22 on the top cover 2, a spring 42 received within the stepped air hole 22 and mounted around the elongated plug rod body 410 of the headed plug rod 41, a headed screw 43 fastened to the elongated plug rod body 410 of the headed plug rod at the bottom, a rubber ring 45 and a gasket 44 mounted on the headed screw 43 and retianed between the head of the headed screw 43 and the elongated plug rod body 410 of the headed plug rod 41. The headed plug rod 41 is pushed upwards by the spring 42 causing the rubber ring 45 to seal the stepped air hole 22. When the headed plug rod 41 is depressed, the rubber ring 45 is moved away from the stepped air hole 22, and therefore air is allowed to pass through the notches 412 and the stepped air hole 22.

We claim:

1. A container comprising:

a container body having a top opening, a top flange disposed around said top opening, a raised retaining portion on a top of said top flange, and an air guide groove on an outer surface of said top flange;

a cover received on said container body and covering said top opening, said cover having a bottom flange fitted around said top flange of said container body and a top with a stepped air hole, said top having an inner surface with a recessed retaining portion, said bottom flange having an inner surface with an air guide groove and a notch at a bottom end of said air guide groove;

a push-button plug assembly fastened to said stepped air hole of said cover, said push-button plug assembly arranged to permit passage of air through said stepped air hole when pressed and to otherwise prevent passage of air through said stepped air hole; and wherein said notch and air guide groove of said cover and said air guide groove of said container body are arranged to permit passage of outside air into said container body when said recessed retaining portion is engaged with said raised retaining portion; and said notch and air guide groove of said cover and said air guide groove of said container body are arranged to prevent passage of outside air into said container body when said recessed retaining portion is disengaged from said raised retaining portion.

2. The container of claim 1, wherein said bottom flange of said cover is in a shape of a cylinder and a diameter across an inner wall of said bottom flange increases in length from said top of said cover, and said top flange of said container body is in the shape of a cylinder having a diameter decreasing in length toward said top opening.

3. The container of claim 1, wherein said push-button plug assembly comprises a plug rod having a head with two opposite notches and a plurality of downward projecting strips and an elongated plug rod body inserted through said stepped air hole of said cover, a spring received within said stepped air hole and mounted around said elongated plug rod body, a screw fastened to a bottom of said elongated plug rod body, a rubber ring and a gasket mounted on said screw and retained between a head of said screw and said elongated plug rod body.

* * * * *